United States Patent [19]

Arena-Ochoa

[11] 4,276,496

[45] Jun. 30, 1981

[54] GAS DISCHARGE LAMP EMPLOYING A PULSE GENERATOR WITH A DOUBLE STAGE AMPLIFICATION CIRCUIT

[76] Inventor: Guido Arena-Ochoa, Colina de la Ilusion #49, Fraccionamiento Bulevares, Estado de Mexico, Mexico

[21] Appl. No.: 58,672

[22] Filed: Jul. 18, 1979

Related U.S. Application Data

[63] Continuation-in-part of Ser. No. 914,996, Jun. 13, 1978, abandoned.

[51] Int. Cl.[3] ..... H05B 37/00; H05B 39/00; H05B 41/14

[52] U.S. Cl. ..... 315/206; 315/205; 315/209 R; 315/276; 315/DIG. 2; 315/DIG. 5

[58] Field of Search ..... 315/DIG. 2, DIG. 5, 315/DIG. 7, 205, 209, 206, 276; 307/315; 331/113 A

[56] References Cited

U.S. PATENT DOCUMENTS

| | | | |
|---|---|---|---|
| 3,683,266 | 8/1972 | Ito | 331/112 |
| 3,710,177 | 1/1973 | Ward | 315/DIG. 2 |
| 3,758,841 | 9/1973 | Bourbeau | 331/113 A |
| 3,889,153 | 6/1975 | Pierce | 315/DIG. 5 |
| 3,922,582 | 11/1975 | Pitel | 315/DIG. 2 |
| 4,045,711 | 8/1977 | Pitel | 315/DIG. 5 |
| 4,060,758 | 11/1977 | Wright | 307/315 |
| 4,127,795 | 11/1978 | Knoll | 315/205 |
| 4,127,798 | 11/1978 | Anderson | 315/DIG. 7 |

*Primary Examiner*—Saxfield Chatmon, Jr.

*Attorney, Agent, or Firm*—Roylance, Abrams, Berdo & Farley

[57] ABSTRACT

A solid state ballast circuit for a discharge lamp includes a transistor oscillator with a current amplifier connected to a transformer one secondary winding of which is connected to the lamp and another secondary winding of which is coupled to the amplifier input. An inductive choke coil is connected in the power circuit of the amplifier so that when the lamp burns out or is removed the operating frequency increase resulting from the decrease in load circuit capacitance results in an increase in impedance of the choke, drastically reducing current flow through the amplifier power circuit to prevent transistor damage or RF interference radiation. The current amplifier disclosed is a two-stage emitter follower circuit.

6 Claims, 2 Drawing Figures

GAS DISCHARGE LAMP EMPLOYING A PULSE GENERATOR WITH A DOUBLE STAGE AMPLIFICATION CIRCUIT

This application is a continuation-in-part of copending application Ser. No. 914,996, filed June 13, 1978, and now abandoned.

This invention relates to an apparatus for starting and operating a gas discharge lamp, particularly of the low pressure type, in which a pulse generator includes a double stage amplification circuit and means for protecting the circuit in the event of a radical change in load characteristics.

BACKGROUND OF THE INVENTION

Feedback oscillators which take advantage of transistor amplification have been the subject of patents and other publications for more than twenty-five years. However, the application of such oscillators for igniting and operating low pressure gas discharge lamps is of more recent origin. The earlier patents demonstrating that system efficiency is augmented considerably when the operating frequency is above 60 Hertz goes back approximately twenty years.

The recognition of the resulting improvement in system efficiency has resulted in the development of various circuits employing feedback oscillators with transistors and one or more transformers with two or three windings in the feedback circuit, but from the most simple to the most sophisticated circuits, each presenting a variety of protective devices, none have given serious consideration to the increase in operating frequency which results from a decrease in system capacitance on tube burn-out for the automatic control of system current.

The failure to consider frequency increase has relegated present oscillator systems to be utilized only with lamps of small power handling capacities (below 20 watts) with circuit input voltages below 100 volts, and such circuits involve relatively high production costs.

Moreover, at the present state of the art, none of these oscillators benefit from the advantages offered by a double stage of amplification, which reduces to a minimum the current which flows through circuit resistors which, in turn, produces a substantial reduction in heat losses ($I^2R$ losses). These losses have resulted in relatively heavy losses in other systems. Furthermore, when voltages are in excess of about 100 volts, these oscillators when operated as ballasts lack reliability since, in most cases, under open-load circuit or lamp burn-out conditions, the power transistor is automatically condemned to overheating damage or, as a result of the protective circuits designed to protect against current or voltage overload, the ballast oscillator becomes limited in establishing the initial igniting arc, at which time the oscillator currents and voltages can reach unusually high values, as compared with normal operating values, until the system becomes stabilized.

In other cases, where the input voltages are low, (e.g., 12 volts) the transistor need not necessarily burn out under open circuit conditions. However, under high frequency circuit conditions the oscillator is often converted into a true transmitter radiating signals at radio frequencies which interfere with nearby communication systems.

As a result of these malfunctions in the oscillator driven systems, the conventional 60 Hertz electrical ballast system continues, after some 20 years of experimentation with other forms of circuits, to dominate almost 100% of the fluorescent tube ballast market, despite the many important realizable advantages promised by the more sophisticated solid state ballast systems.

BRIEF SUMMARY OF THE INVENTION

Accordingly, an object of the present invention is to provide an electronic, solid-state system for use as a ballast in starting and operating a discharge lamp employing a high frequency oscillator or pulse generator which provides considerable efficiency advantages over previously used systems.

A further object is to provide a solid-state pulse generating system for driving a transformer to ignite and operate a discharge lamp which includes protective means for preventing radio frequency interference or transistor burn-out in the event of changes in load reactance.

Briefly described, the invention includes a solid-state ballast circuit for starting and operating an electric discharge lamp and for preventing over-current or electromagnetic radiation conditions in the event of a lamp burn-out or removal, comprising the combination of a DC power source, a transformer having a primary winding and first and second secondary windings, capacitor circuit means for connecting the first secondary winding to the discharge lamp for supplying operating voltage thereto, a pulse generating circuit including amplifier circuit means coupled to the DC source and having an input and an output for supplying current to the primary winding, the amplifier circuit means including first and second DC coupled transistors with said input at the base of the first transistor and the output at the emitter of the second transistor, the output being connected directly to the primary winding, and circuit means including a resistor and a signal diode in series circuit relationship with the secondary winding for providing a feedback signal to the input of the amplifier; the circuit further including an inductive device connected between the collector of one of the transistors and the DC source, and a capacitor connected between the output and the second secondary winding whereby, in the event of lamp burn-out or removal and a consequent increase in operating frequency and transformer primary current, the inductive device reduces primary current to a predetermined safe level.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
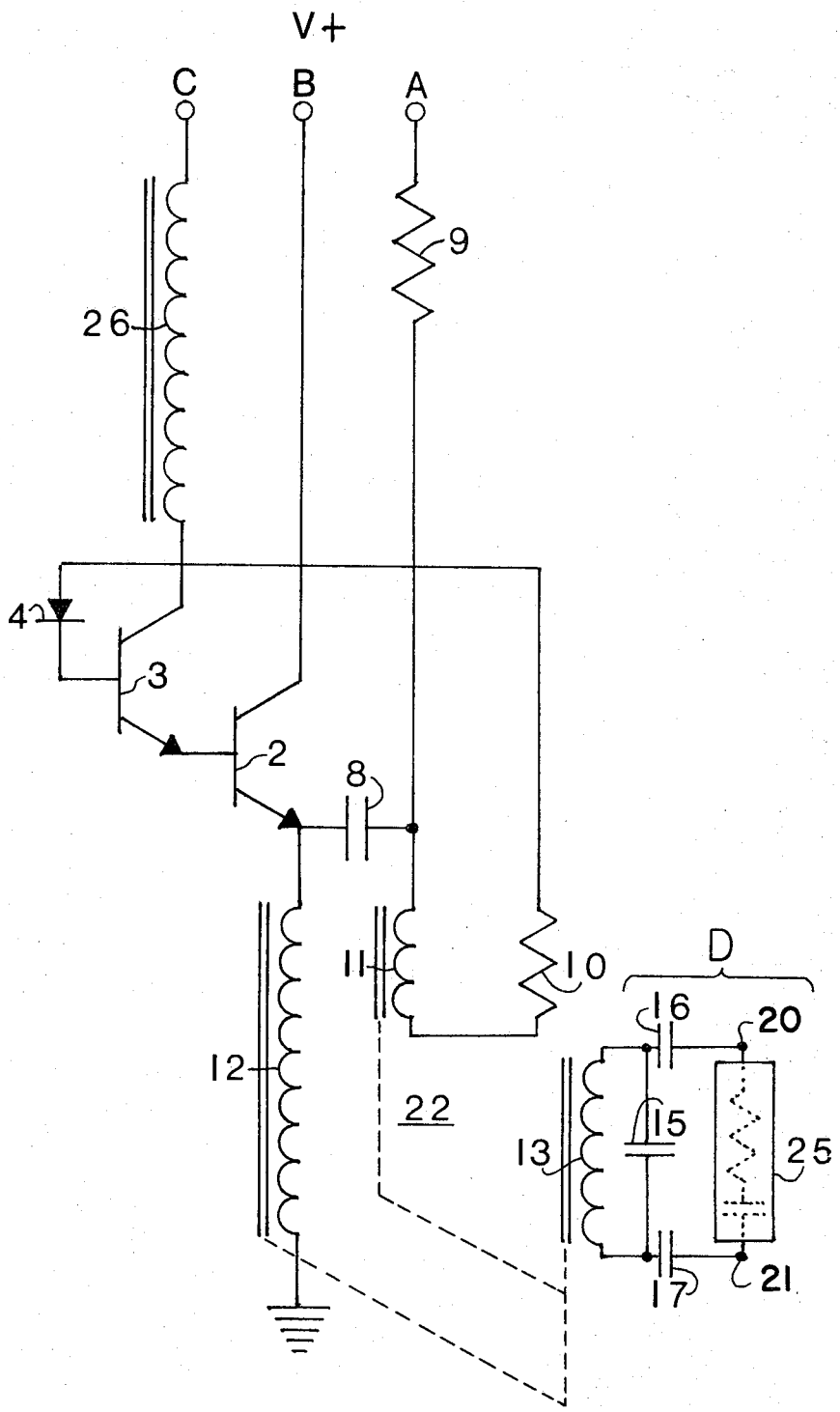
FIG. 1 is a simplified schematic circuit diagram of an apparatus in accordance with the invention, showing the basic components thereof with some conventional components omitted therefrom for simplicity of illustration and explanation.

Before discussing the drawings in detail, a brief discussion of the general arrangement and operation of the system will be provided. The feedback oscillator, or pulse generator, of the transistorized circuit of the present invention utilizes very low direct current pulses for both conduction and non-conduction periods in order to reduce to a minimum heat losses in the limiting resistors and in a phase correcting resistor. The low direct current pulses are amplified in each of the two transistors used in the circuit to produce a pulse which is delivered to the primary winding of a transformer and, finally, to be induced in a secondary winding of the transformer and coupled to the load which is a low pressure gas discharge lamp such as a fluorescent lamp. The flow of current through the primary winding of the transformer induces an alternating voltage in the secondary winding which generates the alternating current flow necessary to start and operate the lamp which is viewed herein as the load. The lamp is presented to the system as a load having an equivalent circuit representable by a resistor and a capacitor in series circuit relationship.

In order for the system to oscillate, a third winding added to the transformer produces a small inverse pulse (out of phase as determined by the total capacitance of the system) which will block or nullify the current in the transistor portion of the circuit, thus overcoming and stopping conduction in both of the first and second transistors. This terminates the first cycle of operation and, at the conclusion of that feedback pulse, a new oscillation cycle is initiated. The automatic control of output current in this high sensitivity oscillator is obtained by using the frequency of the oscillations. In other words, any increase in system frequency produces a corresponding increase in the inductive reactance of a high inductance choke coil placed in the collector circuit of the first transistor which constitutes the first stage of amplification. Thus, if oscillation frequency increases, the large increase in inductive reactance reduces the base-emitter current in the second transistor to near zero level, thereby limiting the current in the transistor output circuit to a very small value.

Such an increase in frequency, which is a normal condition occurring when a lamp burns out or is otherwise removed from the system, is occasioned by a reduction in system capacitance and must be given serious consideration in systems using electronic ballasts for low pressure gas discharge lamps, or fluorescent lamps, if the system is to be dependable under all working conditions. The circuit of the present invention, even when subjected to conditions of increased frequency for long periods of time when a lamp burns out, will not result in transistor damage nor become a transmitter of radio frequencies which can cause interference in nearby communication systems since the output current, as a result of the control action, is reduced below overheating or transmitting levels.

Turning now to the drawings, it will be seen that the circuit of FIG. 1 includes two transistors 2 and 3 which are DC coupled in a manner similar to a Darlington circuit, the emitter of transistor 3 being connected directly to the base of transistor 2. The emitter of transistor 2 is connected directly to one end of primary winding 12 of transformer 22, the other end of which is connected to ground, and to one terminal of a capacitor 8. As indicated in FIG. 1, the system can be viewed as including three circuits A, B and C. For explanation purposes, these three circuits will be regarded as beginning at a source of DC power V+ and the currents of the three circuits are summed in winding 12 as they flow to the opposite terminal of the source, indicated as ground.

The other terminal of capacitor 8 is connected to one terminal of a secondary winding 11 of transformer 22, the other terminal of which is connected through a series resistor 10 and a series signal diode 4 to the base of transistor 3. This same terminal of capacitor 8 is also connected through a resistor 9 to the positive source at point A. The collector of transistor 2 is connected to the positive source at B and the collector of transistor 3 is connected through an inductance which will be referred to as choke coil 26 to the positive source at C.

The load circuit includes secondary winding 13 of transformer 22, a capacitor 15 connected across the terminals of winding 13, series capacitors 16 and 17 to terminals 20 and 21, respectively, between which the discharge lamp 25 is connected. As indicated in dotted lines, the lamp can be viewed electrically as an equivalent circuit including a series resistor and capacitor.

Also as indicated in dashed lines, the transformer windings 11, 12 and 13 are on the same ferrite core.

The operation of the system is initiated by a small direct current, limited by resistor 9, which begins to flow toward ground. This small current passes through winding 11 of transformer 22, through resistor 10, through forward biased diode 4, through the base-emitter circuit of transistor 3, through the base-emitter circuit of transistor 2, and through primary winding 12 of transformer 22 to ground. This circuit can be regarded as circuit A or the signal circuit.

At this point, the two transistors, which have different amplification factors beta, are rendered conductive. Transistor 3, which is designed and selected to carry less current in its collector than transistor 2, has an amplification factor somewhat greater than that of transistor 2, its amplification factor being, for example, in the order of 100.

When transistor 3 becomes conductive, its collector-emitter circuit, which will be referred to as part of circuit C or the control circuit, becomes active. Circuit C begins at the positive source with current flowing through the high inductance choke coil 26, through the collector-emitter circuit of transistor 3, through the base-emitter circuit of transistor 2, and through winding 12 of transformer 22 to ground. It will be observed from circuits A and C that a small current in circuit A can release or activate a current up to 100 times greater in circuit C, the maximum current flow being a function of the inductive reactance of choke 26. This greatly increased current in circuit C on passing through the base-emitter circuit of transistor 2 can make that transistor highly conductive and thus activate circuit B, the power circuit. As a result of the conductivity of transistor 2, a current flowing from point B at the positive source passes through the collector-emitter circuit of transistor 2 and through winding 12 of transformer 22 to ground. As a consequence of the amplification factor of the second transistor 2, which is in the order of 10, the current in circuit B is 10 times the current in circuit C and approximately 1000 times greater than the current in circuit A. Thus, two stages or steps of amplification are provided in the present invention.

The addition of currents A, B and C in primary winding 12 of transformer 22 induces in secondary winding 13 an alternating current for starting and operating lamp 25 in the load circuit D, to be described.

An induced voltage in winding 13 of transformer 22 causes flow of alternating current through the circuit including capacitor 16, lamp 25, capacitor 17 and the winding 13. This current ignites and operates lamp 25.

After the currents in the four circuits A, B, C and D begin to flow, they increase, reaching a maximum value limited by the system load at lamp 25. At this point, an inverse voltage is induced across the tertiary winding 11 (or secondary winding) of transformer 22 which overcomes the current in signal circuit A which is then returned to zero, causing transistors 3 and 2 to become non-conductive, also suspending the flow of current in circuits B and C and changing the direction of current flow in circuit D. The frequency of system oscillation is a function of the discharge time of capacitors 8, 15, 16 and 17, as well as the capacitance of tube 25. A typical frequency of operation is 20,000 Hertz.

The phase angle of the inverse voltage induced in winding 11 of transformer 22 to stop system conduction is initially adjusted with respect to the current in circuit A by selection of the proper value of resistor 10 in conjunction with the capacitance of capacitor 8 and the inductance of winding 11. The result of this adjustment can be observed in the reduction in temperature of transistor 2, thus improving considerably the switching conditions of this transistor.

Having considered the normal operating conditions of the system, consideration will now be given to the circumstances which result from an open circuit condition as when the lamp burns out or is removed from terminals 20 and 21.

One of the most difficult operating conditions for oscillator type ballasts utilized in starting and operating gas discharge tubes occurs when the load circuit is opened, which normally occurs when the lamp is burned out. At this time, the behavior of the oscillator is as follows: At the moment that lamp 25 is removed from circuit D only winding 13 of transformer 22 and capacitor 15, the capacitance of which is many times smaller than the capacitance of any of capacitors 16, 17 or 25 (the capacitance of the tube), will remain as part of the load. Thus, the total system capacitance undergoes a great reduction and the oscillation frequency increases.

Under these new system conditions, the current in winding 12 of transformer 22 is reduced due to higher reflected impedance from winding 13. If the frequency should remain the same under open circuit conditions, the current in winding 12 of transformer 22 would be almost negligible since the transformer is primarily designed for a fairly narrow range of frequencies. However, when the frequency increases, for example to a frequency ten times higher than normal, under open circuit conditions the magnetic core material of the transformer acts in a very distinct way in that, when frequency increases, the permeability of the magnetic core material reduces with a consequent increase in reluctance. In order to maintain the fixed magnetic flux on increasing the reluctance, it is necessary to also increase the electromagnetic force measured in ampere-turns. However, since the turns of winding 12 have been calculated for a frequency many times smaller, and since the number of turns is fixed, the current flow in winding 12 must increase in order to maintain the open circuit condition of winding 13 of transformer 22 at the new higher frequency.

To mitigate this problem of increased frequency with substantial current flow in the power circuit of transistor 2, the conduction of transistor 2 is reduced by inserting a high inductance choke coil in circuit A of transistor 3. At the new higher frequency, this choke is designed to limit current in circuit C of transistor 3 to a predetermined value which will thereby limit current in circuit B of transistor 2 to a safe value which will not prove dangerous to the switching of the transistor and, furthermore, that the magnitude of this high frequency current is maintained below the threshhold radiation level which might produce signals capable of interfering with nearby communication systems, until such time as the oscillator is disconnected from the power source or until normal operation is reestablished by the installation of a new lamp.

The high inductance choke coil 26, as a result of design and position in the circuit of the oscillator, is also utilized to attenuate transient phenomena generated in the circuit, for example, due to incorrect contacting at lamp terminals 20 and 21 or by damaged lamp filaments, which might be induced in winding 11 of transformer 22 and fed back into the oscillator and amplified by transistor 3.

Figure 2:
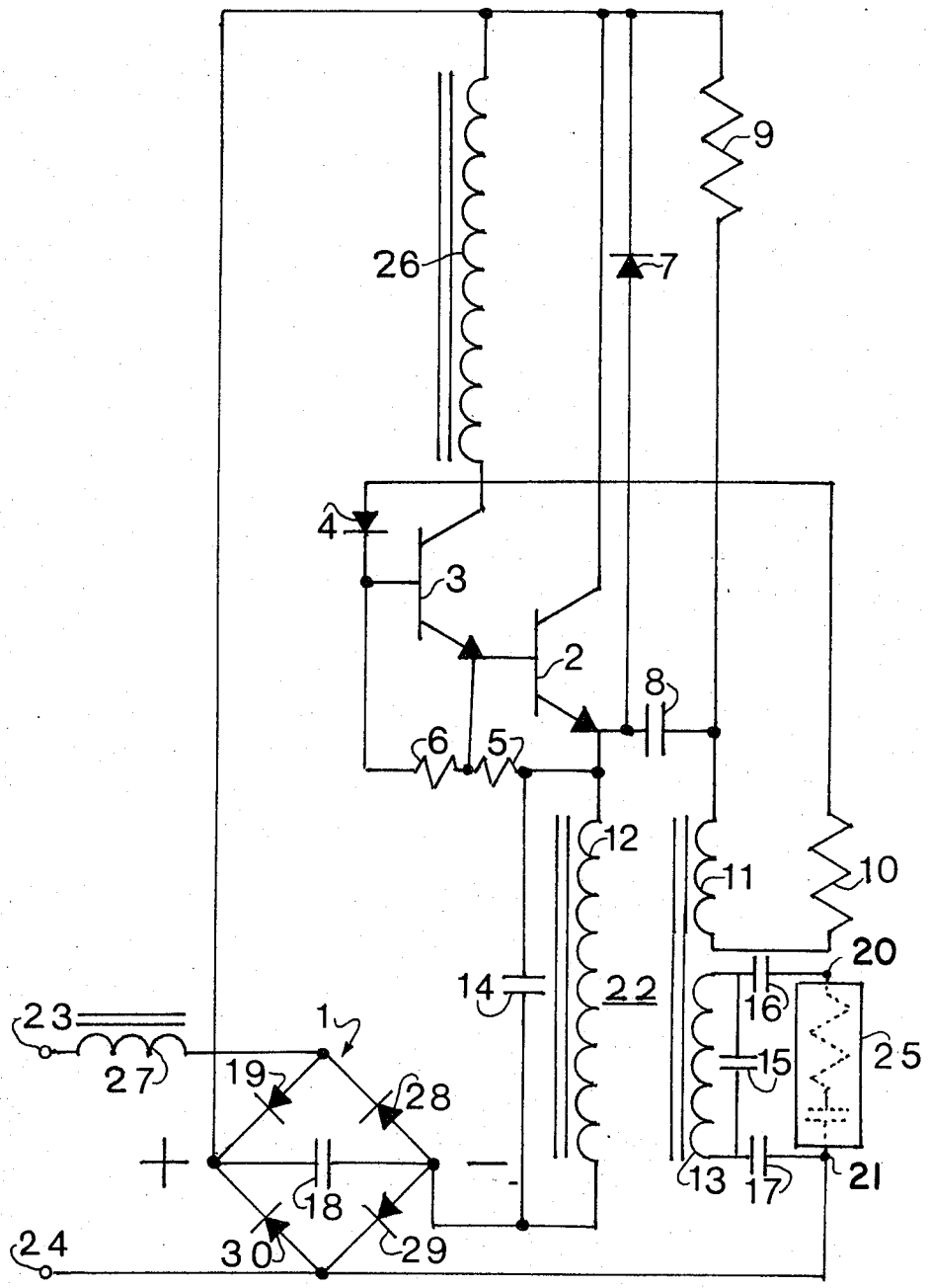
FIG. 2 is a schematic diagram of an apparatus according to the invention showing, in a more complete form, the circuit elements used in a system operating from line voltage.

Referring now to FIG. 2, it will be recognized that this circuit is basically the same as the circuit of FIG. 1 but with the addition of other components necessary for operation including a bridge rectifier including diodes 19, 29, 28 and 30, and a filter capacitor 18 which provides the positive voltage V+ at the terminal points A, B and C of the circuit of FIG. 1. Also, an induction coil 27 is provided for suppressing transients originating in the external circuitry, this choke coil being connected in series with the power line. Also included are resistors 5 and 6 which are employed to bypass a portion of the current in circuits A and B respectively until desired design values are reached. It will be observed that these resistors are not required in low voltage systems designed to operate, for example, from a 12 volt supply. A capacitor 14 and reverse biased diode 7 are incorporated to protect transistor 2 from excessively high inverse peak voltages generated across winding 12 of transformer 22 during switching. Finally, the connection of one terminal of lamp 25 with the junction point between diodes 29 and 30 is to drain off electrostatic charges which are apt to accumulate in a lamp 25 during operation.

For completeness, the following example is given of component types and circuit element values for a circuit operating from a 120 VAC power source.

The core material for choke 26, choke 27 and for transformer 22 is type 05 ferrite supplied by Indiana General Corp., or equivalent. The winding on the choke is 200 turns of AWG 33 wire on a core having a 5/16" diameter and 2.75" length. The nominal core rating at 120 volts is 40 watts, the choke being saturable. Choke 27 uses a 5/16" diameter and 1" long core with 20 turns of AWG 23 wire. Transformer 22 has a straight core with 450 turns of AWG 28 for winding 13; 120 turns of AWG 23 for winding 12; and 4 turns of AWG 28 for winding 11.

The diodes for the bridge as well as diodes 4 and 7 are type 1 S 1943. Transistor 3 is a Fairchild EMP 7059, and 2 is a Toshiba BUY 69A.

Following are resistor and capacitor values:

| | |
|---|---|
| R5 | 51Ω |
| R6 | 200KΩ |
| R9 | 60KΩ |
| R10 | 51Ω |
| C8 | .022μf |
| C14 | .000047μf (3 KV) |
| C15 | .000047μf (3 KV) |
| C16 | .01μf (1600 V) |
| C17 | .01μf (1600 V) |

-continued

| | |
|---|---|
| C18 | 10μf |

While certain advantageous embodiments have been chosen to illustrate the invention it will be understood by those skilled in the art that various changes and modifications can be made therein without departing from the scope of the invention as defined in the appended claims.

What is claimed is:

1. A negative feedback DC-AC inverter for powering a gaseous discharge lamp which has open-circuit portection by frequency and comprises:

a non-saturating core transformer having a primary winding, a first secondary winding and a second secondary winding;

a first and a second transistor connected as a Darlington pair, the collector of said first transistor being connected to a terminal of a DC power source through a high inductance choke coil, the collector of said second transistor being directly connected to said terminal of the DC power source, the emitter of said second transistor being connected to an opposite terminal of said DC power source through said primary winding of said transformer;

a negative feedback circuit which comprises said second secondary winding, a resistor, a diode, a base-emitter junction of said first and second transistor Darlington pair and a capacitor;

a bias resistor connected between said DC power terminal and a junction point of said second secondary winding of said transformer and said capacitor in said feedback circuit to provide biasing potential to said base of said first transistor for conductivity;

said first secondary winding of said transformer in open circuit is shunted by a very small capacitor whereby the inverter frequency is increased considerably.

2. A circuit according to claim 1, wherein switching means comprises said second secondary winding to said base of first transistor provides, across said second secondary winding of said transformer, a negative feedback exclusively for blocking said inverter.

3. A circuit according to claim 1 which provides frequency controlled open-circuit protection and comprises said high inductance choke coil connected in the collector of said first transistor, said diode connected to the base of said first transistor and the low capacitance capacitor shunting said first secondary winding of said transformer which, during open-circuit operation, provides a frequency increase of approximately four times normal operating frequency, producing increased reactance in said high inductance choke coil thereby protecting the circuit through a reduction in inverter current.

4. A circuit according to claim 1 which also comprises a resistor between said base and said emitter of the said first transistor and a resistor connected between said base and said emitter of said second transistor.

5. A circuit according to claim 1 with a direct current source which comprises a full wave AC-DC rectifier with a filter capacitor shunted across its output terminals.

6. A circuit according to claim 1 wherein a diode with a cathode connected to said collector and an anode connected to said emitter of said second transistor.

* * * * *